US007752953B2

(12) United States Patent
Sokol et al.

(10) Patent No.: US 7,752,953 B2
(45) Date of Patent: Jul. 13, 2010

(54) METHOD AND SYSTEM FOR NEUTRALIZATION OF BURIED MINES

(75) Inventors: David W. Sokol, Dublin, OH (US); Jeff L. Dulaney, Dublin, OH (US); Craig T. Walters, Powell, OH (US)

(73) Assignee: LSP Technologies, Inc., Dublin, OH (US)

( * ) Notice: Subject to any disclaimer, the term of this patent is extended or adjusted under 35 U.S.C. 154(b) by 725 days.

(21) Appl. No.: 10/386,644

(22) Filed: Mar. 12, 2003

(65) Prior Publication Data

US 2004/0200341 A1 Oct. 14, 2004

(51) Int. Cl.
*B64D 1/04* (2006.01)
*F41F 5/00* (2006.01)

(52) U.S. Cl. ..... 89/1.13

(58) Field of Classification Search ..... 86/50; 102/402, 403; 89/1.13
See application file for complete search history.

(56) References Cited

U.S. PATENT DOCUMENTS

| | | | | |
|---|---|---|---|---|
| 3,177,651 | A * | 4/1965 | Lawrence | 60/204 |
| 3,235,816 | A * | 2/1966 | Wanless | 372/77 |
| 4,773,298 | A * | 9/1988 | Tischer et al. | 89/1.13 |
| 5,222,073 | A | 6/1993 | Epstein et al. | |
| 5,526,372 | A | 6/1996 | Albrecht et al. | |
| 6,199,794 | B1 * | 3/2001 | Naiman et al. | 244/3.16 |
| 6,487,950 | B2 * | 12/2002 | Samland | 89/1.13 |

FOREIGN PATENT DOCUMENTS

| | | | |
|---|---|---|---|
| EP | 305556 | A1 * | 3/1989 |
| GB | 2184068 | A * | 6/1987 |
| JP | 11023194 | A * | 1/1999 |
| JP | 2001317897 | A * | 11/2001 |

OTHER PUBLICATIONS

Marco A. Morales, Directed Energy Test & Evaluation Conference, Aug. 13-15, 2002.*

Mark Scott, Weapon Systems Technology Information Analysis Center: Progress in Directed Energy Weapons Part I: High Energy Lasers, vol. 4, No. 1, Spring 2003.*

(Continued)

*Primary Examiner*—Troy Chambers
(74) *Attorney, Agent, or Firm*—Benjamen E. Kern

(57) ABSTRACT

A system for neutralizing a buried mine includes a laser that is configured to generate laser energy that communicates through the covering ground material and accesses the mine in a manner sufficient to neutralize the mine. Neutralization can occur by deflagration or detonation. The laser includes a solid-state lasing medium that is run substantially uncooled during the lasing run. Namely, the lasing medium is operated without cooling until the lasing medium reaches a temperature where thermal population in a lower laser level begins to significantly lower inversion density. Following completion of the lasing run, the lasing medium is cooled at a rate limited only by a thermal stress fracture level of the lasing medium. Operation of the laser in this manner permits the laser to deliver high-irradiance, high-repetition rate pulses according to a burst mode operation that successfully accomplishes neutralization in a desired time period. The burst mode also facilitates preferential selection of the mechanism of laser energy-material interaction to promote rapid penetration rates.

19 Claims, 6 Drawing Sheets

OTHER PUBLICATIONS

Steukers, Catherine and Schweicher, Emile, Neutralisation and Destruction and Removal of landmines, Apr. 24, 2001.*

Improvement of the techniques of mine clearance ans subjects of studies, author unknown, Sep. 22, 2002.*

ZEUS Home page, www.zeus.sparta.com/, Laser-based unexploded orndnance and landmine neutralization system.*

Reuters: US to Test Mine-Zapping Laser Cannon, Jul. 10, 2002.*

Dr. Owen C. Hofer, Laser Neutralization of Submunitions for Active Range Clearing, befor Fall 1998.*

Internet print-out regarding Zeus from Sparta, Inc., 6 Sheets Total.

*Nd-Glass Burst Laser*, H.M. Epstein et al., Proceedings of the International Conference of Lasers' 89, Dec. 3-8, 1989, pp. 1122-1128.

*High-Average-Power, Low-Temperature-Gradient Rod Laser*, H. M. Epstein et al., Proceedings of the International Conference on Lasers '91, Dec. 9-13, 1991, pp. 621-624.

*Nd-Glass Burst Laser with kW Average Power Output*, C. T. Walters, et al., IEEE Log No. 9407788, 1995, pp. 293-300.

*The Solid-State Heat-Capacity Laser: A Mobile Source of Pulsed Directed Energy*, C. Brent Dane, LLNL High Energy Pulsed Laser Lethality Effects and Beam Propagation Workshop, Aug. 28, 2002, 36 pages.

* cited by examiner

METHOD AND SYSTEM FOR NEUTRALIZATION OF BURIED MINES

BACKGROUND OF THE INVENTION

1. Field of the invention.

The present invention relates to a method and system adapted to neutralize a buried mine, and, more particularly, to a laser-based platform configured to generate laser energy that penetrates through ground material and irradiates a buried mine to perform a neutralization task, as part of an overall lasing run characterized by a high-pulse-repetition rate burst mode of operation.

2. Description of the related art.

The clearing of land mines from routes of advance, battlefields, airfields, and legacy areas remains a daunting and dangerous task for the military forces. Advanced technology must be developed which will increase the reliability of detection, increase the speed of mine clearing, and reduce the risk to the soldier carrying out the mission. The problem logically breaks down into the tasks of mine detection/localization and of mine neutralization.

Mine detection techniques include ground penetrating radar (GPR), electromagnetic, magnetic, electro-optic, infrared, acoustic, seismic, chemical, and biochemical methods. Typically, no single method is likely to be able to detect all types of mines, which come in a variety of sizes, shapes, and constituents. The solution ultimately will be a suite of high performance detectors acting in concert to detect and localize a mine threat.

The second part of the problem is to neutralize the mine threat, given its location. A variety of techniques have been used for neutralizing mines and unexploded ordnance (UXO). Conventional technology employs a high explosive (HE) charge placed close to the mine, which is then detonated. However, causing the mine to be destroyed in a high-order detonation produces considerable damage to the surrounding area, which is often undesirable.

For example, in a route-clearing mission, the road might have to be repaired. The explosive neutralizers also pose risks to soldiers in the case of manual placement and risks to high-tech hardware in the case of robotic placement.

In integrated detector/neutralizer systems, one current approach is represented by the Mine Hunter/Killer Advanced Technology Demonstrator (MH/K ATD) for route clearing. This system uses an unmanned remotely controlled HMMWV to carry a detection suite and a set of explosive neutralizers and an armored personnel carrier (APC) to carry the control electronics and operators. The remote operation solves the operator safety problem to a great extent; however, explosive neutralizers must be inventoried, transported, and dispensed. The problem of reducing the likelihood of detonation of the mine by use of special shaped-charge designs in the neutralizer has been considered, but their success is also compromised by the attendant collateral damage of detonation.

What is therefore needed, and not apparent in the art, is a system to detect and neutralize mines that preferably is carried out by a single manned vehicle at a safe standoff distance, e.g., neutralize mines at distances greater than 10 m. A favorable neutralization approach will have the following exemplary features:

high probability of deflagration of mine or UXO (as opposed to high-order detonation); standoff range 10-30 m;

precision delivery of neutralizing mechanism (1 cm error);

minimal logistics requirement (no explosives or disposable robots);

global neutralization capability (independent of mine type, shape, disposition, trigger mechanism); and fast neutralization (high rate of advance).

It is also needed to provide a system that addresses the neutralization part of the problem in the context of a target future combat system that will integrate both a detector suite and a neutralization module.

Mechanical methods such as micro-robots, water jets, gas jets, and projectiles are unlikely to meet these requirements, particularly the need to avoid detonation and the need to access buried mines. In the area of directed energy, high-power microwaves are not likely to produce enough power density in the HE to initiate deflagration for practical beam generator equipment. Furthermore, the stray microwave power might be hazardous to operators. Some mines might be triggered by the microwaves, producing a high order event.

SUMMARY OF THE INVENTION

According to the present invention, there is provided a system and method for neutralizing a buried mane. The system includes a laser that is configured to generate laser energy that passes through the covering ground material and accesses the mine in a manner sufficient to neutralize the mine. Neutralization can occur by deflagration or detonation.

The laser includes a solid-state lasing medium that is run substantially uncooled during the lasing run. Namely, the lasing medium is operated without cooling until the lasing medium reaches a temperature where thermal population in a lower laser level begins to significantly lower inversion density. Following completion of the lasing run, the lasing medium is cooled at a rate limited only by a thermal stress fracture level of the lasing medium.

Operation of the laser in this manner permits the laser to deliver high-irradiance, high-repetition rate pulses according to a burst mode operation that successfully accomplishes neutralization in a desired time period with mobile equipment. The burst mode also facilitates preferential selection of the mechanism of laser energy-material interaction to promote rapid penetration rates. A neodymium glass rod lasing medium or another solid state gain medium may be used, each such medium being configured for flashlamp pump or diode pumping.

In one form of the invention, a compact "bolt-on" mobile laser system is provided that is vehicle portable so that mine neutralization can be performed sequentially on several mines, e.g., a minefield. The system has bursts of power sufficient to drill through soil to reach and neutralize buried mines and UXO. This is possible due to the delivery of laser energy of sufficient irradiance/fluence utilizing burst laser technology.

While the invention is discussed in terms of buried mines, the most stressing target, all types of mines, munitions, and UXO in a surface laid or partially covered situation will be considered and, accordingly, are covered by the invention.

One advantage of the present invention is that preferential selection of the mechanism and/or phenomenon of material removal and displacement is possible with appropriate selection of the laser operating parameters.

Another advantage of the present invention is that neutralization of buried mines is now possible due to the ability of the burst laser system to adequately penetrate through the covering material and address the mine effectively and within a rapid run time.

A further advantage of the invention is that the use of a burst laser system combines various advantages not heretofore seen in neutralization schemes, namely, the ability to deliver energy sufficient to both penetrate through intervening burial material and irradiate the mine to effectuate neutralization, and to do so in a time frame (e.g., run time) that is fast and promotes desirable mechanisms of material removal, e.g., substantial non-vaporization of the obstructing material.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 9 is a graph of surface pressure versus irradiance.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
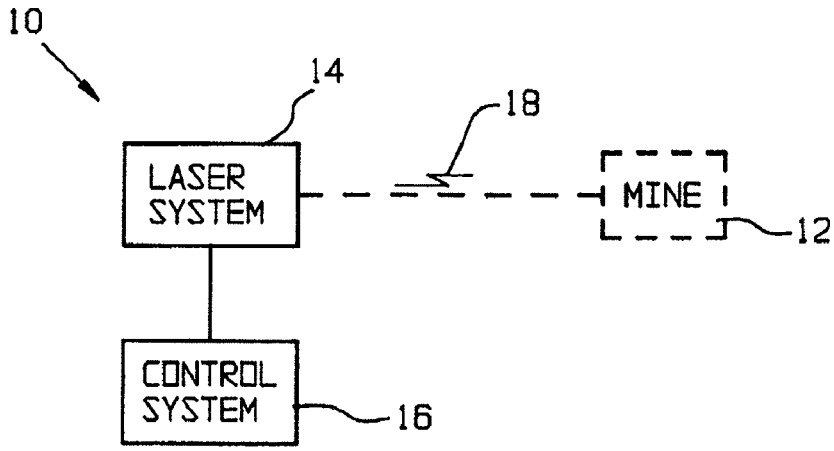
FIG. 1 is a block diagram of a mine neutralization system, according to one form of the invention.

Referring now to the drawings and particularly to FIG. 1, there is shown in general form a mine neutralization system 10 for use in neutralizing a target mine 12.

As shown, the system 10 includes a laser system 14 and a control system 16. The illustrated laser system 14 employs a laser to generate a beam of laser energy that is guided and otherwise directed by means known to those skilled in the art to access mine 12. Control system 16 directs operation and control of laser system 14 and may be implemented with conventional technology. Additionally, control system 16 will be used to control the directional characteristics of the laser beam 18 vis-à-vis mine 12.

According to one form of the invention, mine 12 is disposed at a location such that direct access thereto is not possible, namely, mine 12 is buried. Laser system 14 is suitably designed, constructed, configured, controlled, and otherwise operated such that the generated beam of laser energy 18 penetrates through the intervening matter that buries and/or covers mine 12 and accesses mine 12. In particular, following penetration to the surface of mine 12, the laser beam 18 has sufficient energy delivery characteristics to effectuate neutralization in a manner known to those skilled in the art, e.g., detonation or deflagration (the preferred mode of neutralization).

Any means known to those skilled in the art may be used to apprise control system 16 of the location of mine 12 in order to properly facilitate guidance of the generated laser beam 18 to mine 12 for neutralization thereof.

Figure 2:
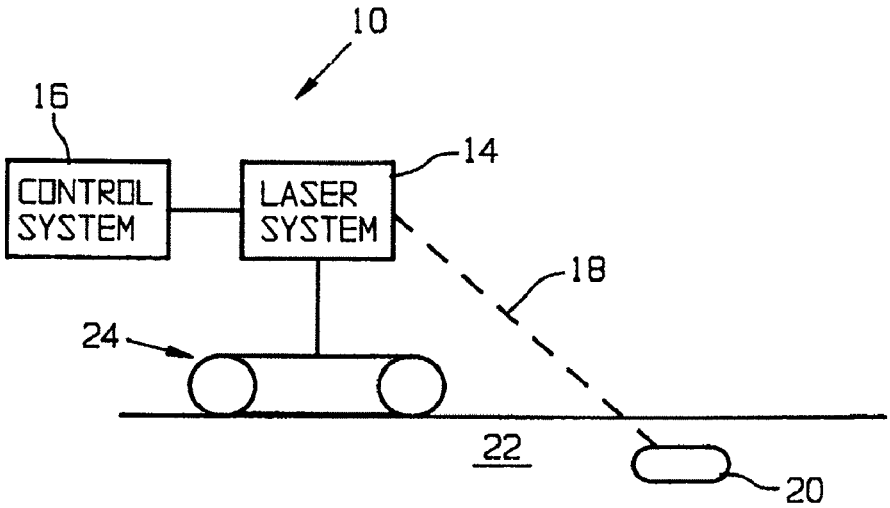
FIG. 2 is a diagrammatic view of an application of the system of FIG. 1.

Referring to FIG. 2, there is shown a pictorial schematic diagram illustrating the manner in which the mine neutralization system 10 of FIG. 1 addresses and otherwise engages a target ordnance (e.g., mine) 20 buried at a subsurface or subterranean location.

FIG. 2 depicts a mobile implementation of the invention in which a vehicle or other suitable platform generally depicted at 24 is adapted to receive the mine neutralization system 10. Any conventional means may be used to integrate the mine neutralization system 10 with a mobile platform. The advantages of having such a mobile embodiment are manifest. For example, in a military or other environment where multiple mines are located, a mobile neutralization unit is useful to patrol the mine district so that it can be readily deployed at each mine site to perform neutralization. The military applications are numerous, in which any of various types of military vehicles may be configured with the invention.

A notable advantage is that the invention can have a "bolt-on" feature, namely, a customized vehicle need not be developed to accommodate its portability, since existing vehicle can be readily retrofitted to carry the unit.

In operation, control system 16 directs laser system 14 to generate a laser beam 18 sufficient to penetrate through the portion or layer of ground material 22 overlying mine 20 and access mine 20. In particular, laser beam 18 penetrates through ground 22 and irradiates mine 20 in a manner sufficient to effectuate a desired neutralization process, e.g., detonation or, preferably, deflagration.

According to another form of the invention discussed further below in connection with FIG. 3, mine neutralization system 10 employs a burst laser design and operation in connection with an Nd:glass rod lasing medium or other solid-state lasing medium operated and configured for high repetition rate and high irradiance characteristics during a laser firing run calculated to fully neutralize a mine.

The burst laser is ideally suited to the mine-clearing mission because it takes advantage of the time between mine encounters to store large amounts of energy for the next mine neutralization task. In burst operation, the glass rod gain medium or other solid-state gain medium is pumped uniformly during the laser operation and the medium is not cooled until lasing has ceased. In this manner, the thermal stresses in the medium are minimal and the only mechanisms limiting run time are the stored energy driving the pump source and the maximum temperature to which the medium may be subjected without damage.

Between lasing periods, the gain media are cooled back to their starting temperature to provide a fast recycle requirement needed in order that multiple mines may be addressed and/or engaged sequentially without long intervening delays. A computer-controlled active gas cooling may be employed to prepare for the next cycle. The cooling time is limited by the thermal shock parameter of the gain medium and the radial conduction time.

The invention also recognizes the multifaceted mechanisms of material penetration to suitably adapt the operating parameters to the environment at hand. For example, the inventors studied soil drilling in the high-irradiance regime where vaporization causes material ejection from the beam path and the long run time permits generation of high aspect ratio holes.

However, other phenomenon of soil removal were identified that were more advantageous, namely, by limiting or eliminating vaporization as the mechanism of soil removal to promote faster penetration rates, i.e., advance of the laser beam to access the buried mine. In particular, a removal mechanism was fostered, effectuated, and/or facilitated by the appropriate selection of laser parameters that involves displacement of the burial material substantially (or at least optimally minimally) in its solid form.

It was further discovered that the repetitive action of short intense pulses may be more effective in removing material from the drill hole in the soil than may be the case for a continuous beam. This is because the interval between pulses allows time for the debris to clear the beam and the higher irradiance levels will create higher driving pressures which remove unvaporized material from the hole.

For example, in another form, an ND:GLASS laser was used to evaluate soil drilling rates on a short time scale with various spot sizes, pulse repetition rates, and peak irradiance levels, in order to develop optimizing laser parameters in relation to minimizing access time, e.g., run time.

By way of example, and not in limitation of the invention, a pulse condition available from the ND:Glass laser is four pulses with a pulse width of 0.5 ms and a repetition rate of 100 Hz. The energy per pulse in this case would be 500 J. The average power for this example is 50 kW and the peak power is 1 MW. The spot size could range from 3 mm to 8 mm yielding peak irradiance levels up to 14 MW/cm$^2$. Longer pulses in the 5-ms range are also available with the ND:Glass laser. The pulse separation or repetition rate is completely variable so that it could be adjusted to optimize clearing time for debris to come out of the hole before the next pulse.

Accordingly, the invention makes it possible to determine a set of design criteria and goals for a bolt-on laser to accomplish mine neutralization in a mobile standoff configuration. The parameters may include, but are not limited to, average power, pulse format, beam quality, and run time per mine target.

Figure 3:
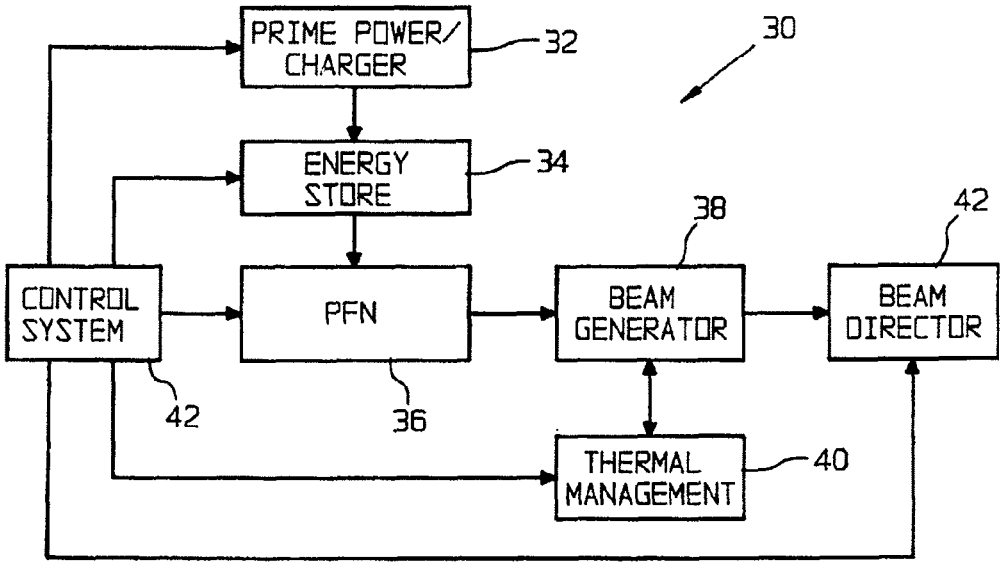
FIG. 3 is a block diagram of a burst laser system, according to another form of the invention.

Referring now to FIG. 3, there is shown a block diagram illustration of a burst laser system 30 for neutralizing a mine, according to another form of the invention.

By way of overview, one form of the invention employs a burst laser design known originally in the art as the Thermal Inertia Laser (TIL) and later referred to as a heat capacity laser. The design is based on the idea of running the solid-state lasing medium uncooled during a lasing run, and cooling the medium between runs. In this manner, very large total energies may be extracted.

The following references are incorporated herein by reference thereto as background material.

H. M. Epstein, C. T. Walters, and J. L. Dulaney, "Rod Lasers," U.S. Pat. No. 5,220,073, Jun. 22, 1993.

G. Albrecht et al., "High Energy Bursts from a Solid State Laser Operated in the Heat Capacity Limited Regime," U.S. Pat. No. 5,526,372, Jun. 11, 1996.

C. T. Walters, J. L. Dulaney, B. E. Campbell, and H. M. Epstein, "Nd-Glass Burst Laser with kW Average Output", IEEE Journal of Quantum Electronics Vol. 31, No. 2, pp. 293-300, February, 1995.

F. C. Way, "Large Area Laser Diode Pumps", Paper DP-4, in DEPS Proceedings of Fourteenth Annual Solid State and Diode Laser Technology Review, May 21-24, 2001.

A. Romero and T. Matty, "Advanced Lithium Ton Systems for Directed Energy Power Sources," in DEPS Proceedings of Fifteenth Annual Solid State and Diode Laser Technology Review, Jun. 3-6, 2002.

H. M. Epstein and J. L. Dulaney, "High-Average-Power, Low-Temperature-Gradient Rod Laser", Proceedings of the International conference On Lasers, Dec. 9-13, 1991, pp. 621-624.

H. M. Epstein, J. L. Dulaney, J. F. O'Loughlin, W. P. Altman, and C. T. Walters, "Nd-Glass Burst Laser", Proceedings of the International Conference on Lasers, Dec. 3-8, 1989, pp. 1122-1128.

One aspect of burst laser technology is the scalability of laser total burst output energy with ND:Glass volume, for example. The basic governing equation is:

$$E = \left[\frac{\rho C_p \Delta T}{\chi}\right]\eta_{ex} V$$

where, E=total output beam energy $\rho C_p$=rod material heat capacity $\Delta T$=rod temperature rise at shutdown of lasing $\chi$=ratio of rod stored heat to extractable laser energy $\eta_{ex}$=laser beam extraction efficiency V=rod volume Using Schott APG-1 laser glass thermal properties, a $\chi$ value of 1.5 (flashlamp pumping), an extraction efficiency of 0.7, and a $\Delta T$ value of 120 C, the extractable stored energy is about 124 J/cm$^3$. An exemplary one-rod system design will have a total ND:Glass volume of about 1200 cm$^3$, which will provide up to 150 kJ of laser output energy in a burst. With diode pumping, the total output energy would be 450 kJ (30-s run time) for the same rod volume ($\chi$=0.5) or the rod volume and system size could be reduced to produce the same total energy.

System Overview

The burst laser system is designed with a view towards meeting the beam parameter goals for mine clearing and will be configured in a manner that will be compatible with conversion to mobile operation, according to another form of the invention. The subsystem elements are illustrated in the block diagram of FIG. 3.

In the portable version of the system, prime power will come from a mobile generator 32 delivering the equivalent of 220 VAC wall power. The prime power will drive a high-voltage charger which will trickle charge the intermediate energy storage bank (energy store 34) over a 20-30 minute time period. It is also possible with further enhancements to reduce this re-charge time to 10 minutes, for example.

The energy storage bank takes advantage of electrochemical capacitor technology in use with hybrid vehicles. When commanded by the control system, the energy store 34 will transfer energy to flashlamp pulse forming networks (PFN's) 36 via a resonant charging intermediate transfer circuit at pulse rates that can be varied from 1 to 50 Hz, for example, although other rates are possible as known to those skilled in the art.

This variation will permit optimization of drilling efficiency for various types of soil and soil condition. The laser can be terminated in its run at any time. For easy mine targets, this would permit neutralization of mines with shorter recovery time between neutralization sequences. This feature is available because the glass output capacity would not be exhausted in a single neutralization event for short burst times.

The PFN 36 transfers energy to linear flashlamps surrounding a thermally insulated ND:Glass rod or other solid-state gain medium in a compact gain module (beam generator 38). One gain module and a set of laser resonator optics arranged in a power oscillator configuration comprise the beam generator.

During a laser run, the ND:Glass rod is uncooled while it is being pumped by the flashlamps, so that its temperature rises uniformly. The flashlamps, however, are cooled by a fast axial water flow from a reservoir in the thermal management system 40. After a run, the flow through the gain module will be stopped and the water will be brought back to the starting condition over the time period for recharging the energy store. In one exemplary form, the beam director 42 may be a simple stationary reflector, while in the mobile system this functionality will be a motorized precision pointing system.

In one example, the invisible beam from a high-power ND:glass laser of the burst system is co-boresighted with a visible green doubled Nd:YAG designator laser or other laser. The system is equipped with a video camera for scene display, and the operator uses a joy stick for target scene scanning and laser pointing. The operator uses a joystick to slew the video surveillance camera to perform surveillance of the scene using the variable zoom lens of the camera as necessary. Once the coordinates of a mine location are determined, this information may be used by the operator to skew the designation laser in the mine direction to thereby fix an aimpoint. The direction-synchronized high-power burst laser is turned on and neutralization commences. Alternately, an automatic servo-control system may be used that automatically guides the directionality of the burst laser to the proper directional aimpoint, according to input location information specifying the location of a mine.

The individual subsystems are discussed below.

Power Supply

The elements of the power supply include the high voltage charger, an Ultracap bank (discussed below), a resonant charging circuit or other transfer circuit, a pulse forming network (PFN), performance sensors, and cabinet housings. The structure of the PFN 36 will take into account design considerations for critically damped flashlamp discharge circuits. This design will be coordinated with the gain-module/flashlamp design which sets requirements on discharge arc length, flashlamp wall peak power density, flashlamp wall average power density, pulse width, and total discharge energy.

Simmering of the flashlamps is taken into account to enhance high-repetition-rate performance. Two exemplary approaches to simmering will be examined, one employing a separate custom simmer supply and one using the Ultracap bank voltage and a ballast resistor. The latter approach is implemented similar to pseudo-simmering, except that the simmer current is left on continuously during a laser run. Flashlamps with an arc length >300 mm are not normally simmered.

The resonant charging circuit transfers energy from the Ultracap bank to the flashlamp discharge capacitor. The design task for this circuit incorporates the circuit parameters for the PFN (e.g., capacitance, inductance, losses, etc.). In one form, for example, the charging circuit employs an inductor in series with a solid-state switch and the discharge capacitor. When the switch is opened, current flows through the inductor, which builds up magnetic field energy and begins the electrolytic capacitor charge cycle. After the current peaks at one fourth of the resonant period, the magnetic field collapses and completes the charging of the capacitor at one half of the resonant period. A diode prevents current reversal. The electrolytic capacitor voltage is not quite double the bank voltage because of resistive losses. An alternative energy transfer circuit may also be used.

The design framework for the PFN and resonant charging circuits will be referenced to thereby determine a requirement for the number of Ultracap cells in the storage bank series stack (estimated at 600-800 cells, for example). The stack will be divided into modules of approximately 100 cells each. Each module will have a relay to dump the module energy into a series load (safety requirement) and a relay to connect the module in series with the other modules to erect the bank voltage. A parallel resistive ladder will be employed to balance the cell voltages in the presence of normal variations in internal leakage resistance. Voltages on each module are monitored as well as the stack voltage.

The power supply design also includes sensors, controls, and interfaces with the control system and the rest of the subsystem components having power requirements, as known to those skilled in the art.

Energy Storage

A component of the general burst laser approach to mine neutralization is the ability of the laser device to project very high average-power beams without the requirement for a large prime power source. Small prime power sources are a requirement for portability and compatibility with highly mobile ground vehicles. The burst laser uses an intermediate energy storage bank to accumulate energy while not actively addressing a mine target and then discharges the energy efficiently on a time scale suitable for mine neutralization.

It is preferable to employ energy storage 34 with discharge times on the order of tens of seconds to promote rapid soil penetration rates and to facilitate rapid re-deployment of the system to other mine sites to initiate successive mine engagement operations. For example, devices meeting these specification include flywheels, inductors, capacitors, and batteries. However, two other beneficial approaches for portable burst lasers are Li-ion batteries and electrochemical double-layer capacitors. Examples of such devices include components made by Maxwell Technologies.

Batteries lend themselves to lightweight systems with energy storage density in the 10-100 W-hr/kg range. Li-ion batteries have the best power density of the major battery types with power density reaching 100 W/kg. These levels are approaching the kW/kg range comparable to power density for Ultracaps. Li-ion batteries might be adapted for use in the system. Ordinary electrolytic capacitors can supply the desired power levels, but typically do not have sufficient energy density to be practical.

The electrochemical capacitor has the ideal discharge characteristics to match illustrative burst laser run times of 1-30 s. Maxwell Technologies has developed an electro-chemical or double layer capacitor (Ultracap) for use in backup power supplies, truck starter boosters, and hybrid vehicles. For example, Maxwell Technologies offers a 2500 F Ultracap with a 400 Amp peak current rating that is adequate for the burst laser system. The follow-on Ultracap has nearly the same electrical characteristics with some change in form factor to accommodate stacking for hybrid buses.

Each Ultracap cell has an operating voltage of about 2.5 V and high voltages can be achieved by stacking the cells in series. Typical stacks of 400 cells have been used for the hybrid bus application. For the burst laser system, 600-800 cells will be used in series to produce bank voltages in the 1500-2000 V range. A single series connected stack will power one gain module. At 1500 V, the stored energy in one gain module bank will be 4.7 MJ.

While electronics could be configured to maintain a constant output voltage during the discharge associated with the laser firing cycle, the simplest, most efficient, and most cost-effective means of extracting energy from the bank is to take power directly from the Ultracaps and let the voltage droop as energy is extracted. This simple approach may be employed so that the system will be sized to meet the mission requirement with the laser average power output at the end of the run.

The Ultracap approach is robust and cost-effective to implement. Li-ion batteries require considerable care and additional electronics to maintain the health of the battery. Li-ion batteries have a limited lifetime in terms of the total number of charge/discharge cycles. Ultracaps can be discharged totally, can endure $10^5$ charge/discharge cycles, and can be charged at the same rate as the discharge rate, if need be. The only required circuitry is a passive parallel resistor ladder to balance the individual cell voltages for enhanced life.

Pulse Forming Network (PFN)

Pulse forming networks (PFN's) 36 for flashlamp discharge circuits and associated safety hardware are conventional components readily adaptable for use in ND:Glass lasers.

An interface circuit is used between the Ultracap bank and the fast flashlamp discharge circuit. Use of an Ultracap cell stack of 600-800 cells is reasonably well matched to the energy requirement of a single gain module, however the voltage 1500-2000 V) is low compared to the nominal requirements for the long flashlamps to be employed. In the rod-type burst laser, the flashlamp arc length must be greater than the glass rod length which may be 610 mm as discussed subsequently. For this length, the flashlamp voltage will be about 2,800 V.

For this purpose, a resonant charging circuit may be used that will charge each flashlamp electrolytic capacitor from the Ultracap bank on command using solid-state switches. Resonant charging leads to a near doubling of the bank voltage and can be accomplished easily in 15 ms, which is less than the 20 ms inter-pulse time at 50 Hz pulse repetition rate. The flashlamps will be fired on command by solid state switches after the electrolytic capacitors have reached their charge voltage. While the resonant charging time will be kept constant in operation (<15 ms), the flashlamps can be fired at longer intervals, if desired, to change the pulse repetition rate in real time.

An alternative energy transfer design may also be used to charge the PFN capacitors.

Beam Generator Design

The beam generator 38 includes the gain module, resonator optics, and active thermal lensing compensator. An important consideration concerns the design of the gain module pump cavity, which preferably will be optimized to achieve uniform pumping of the ND:Glass in order to minimize thermal distortions of the beam. A simple cylindrical reflector approach or any other suitable reflector design may be used.

The tradeoffs in the design will include cavity transfer efficiency, coolant flow optimization, pump light uniformity, and fabrication costs. Ray trace calculations may be performed for the radial energy transport using ZEMAX or other suitable software. Further design aspects include the pump cavity housing, end caps, rod holders, flashlamp seals, and coolant connector fittings.

Based on the pump cavity design calculations, estimates of the radial pump non-uniformity and associated temperature gradients may be made. These estimates may be used to calculate the thermal lensing in the rods as a function of laser run time. To the extent that the radial thermal gradient is parabolic and azimuthally symmetric, a telescope formed with simple spherical lenses can be used to compensate the thermal lensing. The time scale for the thermal lensing will be relatively slow and a dynamic compensator will remove the dominant portion of the beam distortion.

A dynamic compensator may be provided using a positive-negative long focal-length lens pair telescope. One lens will be stationary, while the other will be mounted on a translation stage programmed to move on a trajectory along the beam axis which will continuously compensate the thermal lens.

The compensator and a simple set of stable resonator optics will produce acceptable beam quality. A computer simulation that models the laser rate equations with temperature dependent gain coefficients may be run to predict performance of the system over the entire temperature range of the laser run period. Based on these calculations, the stable resonator optics may be designed to optimize mode volume and beam power extraction efficiency at the design pump condition. A set of unstable resonator optics with a gradient reflectivity mirror output coupler may be used to produce even better beam quality.

Figure 4A:
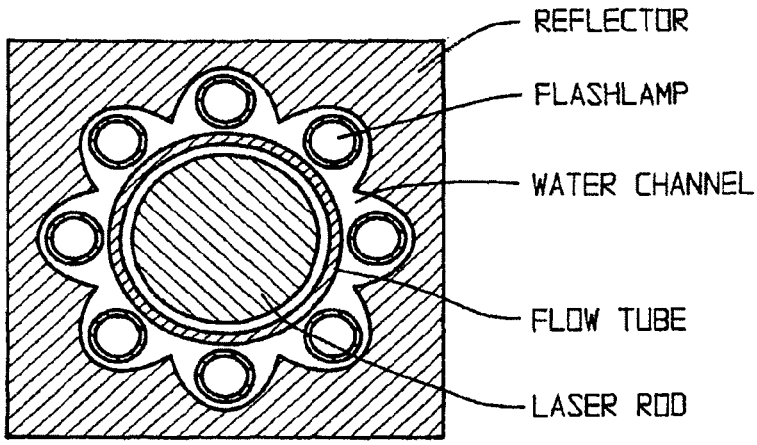
FIG. 4A is a cross-sectional view of a flashlamp-pumped gain module for use in practicing the invention, according to another form thereof.

More specifically, in one exemplary form, construction of the beam generator employs a laser resonator comprising a relatively simple power oscillator with one gain module, cavity optics, and a thermal lensing compensator. In one form, ND:Glass was used as the gain medium due to its availability in large volumes. The rod shape was selected for overall compactness of the system, potential high efficiency in pump cavity energy transfer, and the ability to readily compensate for symmetric components of any non-uniformity in rod heating. This rod design approach will also transfer easily to diode pumping, the cost of which should be lower than for the slab geometry because there is no need for lensing in the diode package to implement rod pumping. The cross-section for the illustrative design for the flashlamp pumped gain module is presented in FIG. 4A.

In one exemplary configuration, the ND:Glass rod is 50 mm in diameter and 610 mm long and may be fabricated from Schott glass type APG-1. A glass tube surrounds the rod and provides a gas gap for rod cooling between laser runs. The glass tube confines the water coolant to a channel surrounding the flashlamps, which must be cooled during the laser run time. The reflector may be machined from aluminum and coated with a high performance gold coating that will provide a greater than 94 percent reflectivity at the primary laser pump bands. The overall head cross-section dimensions will be less than about 150 mm by 150 mm.

Several options are available for design of the laser resonator, depending upon considerations such as beam quality and output power. The beam quality requirement will not be particularly stressing for the short-range mine-clearing mission. Assuming an illustrative output aperture of 200 mm operating at a range of 30 m, the diffraction limited spot would be about 0.16 mm. It is believed that a 2-mm spot diameter will be useful in removing soils, although other spot size dimensions may be used. This criteria leads to a beam quality requirement of about $M^2=12$ for the 30-m standoff range and $M^2=36$ for the 10-m case.

Typical resonators may include a simple multimode stable oscillator having advantageous power extraction, the same oscillator with active telescope dynamic correction of thermal lensing, and an unstable resonator with gradient reflectivity mirror (GRM) and dynamic thermal lensing compensation. Additionally, the laser system may include a deformable mirror or phase conjugate mirror for beam distortion cleanup.

The need to control beam distortion in the gain medium preferably will be minimized by careful pump cavity design to achieve very low thermal gradients in the ND:Glass. The use of 8 flashlamps in a pump head, for example, will smooth azimuthal thermal gradients. Selection of the rod doping density, rod radius, and radial focusing parameters may also minimize the radial thermal gradients that lead to thermal lensing. Employing lamp arc lengths greater than the rod length will minimize end-effect distortions.

Diode Pumping

In one form, as an alternative to flashlamp pumping, laser-diode pumping of the solid-state lasers is selected due to its higher efficiency relative to flashlamp pumping. The advantages of diode pumping are numerous. First, the ratio of heat deposited in the gain medium to available stored beam energy is a factor of three lower than for flashlamp pumping. This means that for the same laser output, the glass heats slower and the run time can be three times longer. Secondly, the electrical power input to achieve the same beam output power is about four times less than in the case of flashlamp pumping. This is a result of matching the diode output wavelength to the ND:Glass primary absorption line and improved pump cavity transfer efficiency through direct beam propagation. Thirdly, the total thermal management load (waste heat) is reduced by about a factor of four for diodes compared to flashlamps. These improvements greatly reduce the size and weight of a portable system.

The use of packaged diode arrays is envisioned by the invention. Companies making this technology available include Laser Diode Array, Inc. (LDAI), Armstrong Laser Technologies (ALT), DIODETEC, Spectrolab, Industrial Microphotonics Company (IMC), and Nuvonyx, Inc.

Figure 4B:
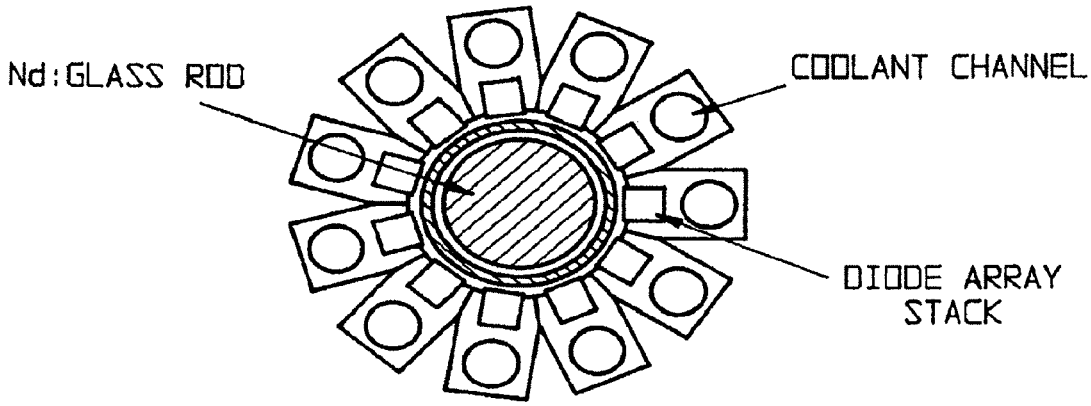
FIG. 4B is a cross-sectional view of a diode-pumped gain module for use in practicing the invention, according to another form thereof.

One exemplary device construction uses the LDAI bars-in-grooves package design. For the rod-type burst laser, this package is advantageous. For example, there is no lensing requirement. In this concept, the arrays are stacked end on end along the rod axis and aligned around the circumference of the rod to give uniform pumping. One illustration of the design is shown in FIG. 4B. The fast axis of the diodes is along the rod axis, which mixes the pump light. One benefit of the bars-in-grooves design is the ability to easily change the bar pitch at design time to optimize the fill factor of the entire array. Another feature of diode pumping of ND:Glass is the fact that the absorption line is wider in the glass host than in crystal hosts and, therefore, precise temperature control of the diode emitter is not as critical as is the case in many applications.

Thermal Management System

The laser system will generate waste heat that must be removed from the system. The major heat load is the flashlamp and reflector wall waste heat which may be removed by an axial flow of coolant in the channel between the flow tube and the reflector. This waste heat load may be reduced by as much as a factor of four by use of diode pumping for a system with the same laser beam average power output.

In one approach, a simple blow-down coolant storage tank may be used to achieve a fast flow in the coolant channel during a lasing run. The flow rate will be sized to minimize total coolant mass while limiting the possibility of boiling at the flashlamp envelope outer wall surface. A low flow will be maintained for a short period after the laser run to allow the flashlamp electrodes to cool. Between runs, the coolant will be recycled to the starting temperature using a conventional laser chiller or will be refilled directly from a fresh water source.

Waste heat also remains in the ND:Glass rod which is uncooled during a laser run to minimize beam distortion. After a laser run, the rod will cool by radiation to the surrounding pump cavity if no active cooling is employed. However, this approach may limit the laser recycle time period to about 30 minutes or more, for example. According to the invention, it is beneficial to use active cooling, such as by low-flow forced convection of air in the channel between the rod and the flow tube, to thereby reduce the recycle time to less than 15 minutes for a full run of the laser, for example.

One important consideration with rod cooling is to keep the radial temperature gradient in the glass well below that level which would create a stress in excess of the fracture stress for the glass. More aggressive rod cooling may be achieved by using higher flow rates and ramping the inlet temperature down as the rod cools to control the surface thermal gradient. Carefully controlled mist cooling systems may also be appropriate.

More specifically, in one exemplary form, the thermal management system 40 may include water storage tanks, pipes, plenums, hoses, and valves. During a laser run, a high flow rate of coolant (e.g., water) will flow in the gain module to cool the flashlamps. The flow rate and inlet temperature requirement for the pump cavity will be determined by thermal convection analysis of the flashlamp coolant channel, given the flashlamp wall and reflector surface heat fluxes determined in the gain module design. Total coolant volume per run will be determined from the pre-lasing flow startup period, the laser run time, and the low-flow post lasing flow period.

Glass-lined liquid storage tanks may be sized to hold the run volume plus margin for possible longer runs. A compressed air blow down system and flow piping may be employed to create the design flow rate of coolant to the gain module. The heated water may be sent to a dump tank from which it will be transferred back to the depressurized source tank for cleanup and cooling.

Interfacing of all air and water solenoid valves to the control system sequencer may use conventional designs. The ND:Glass rod will preferably be cooled between runs to its starting temperature. This starting temperature may be below ambient to permit longer run times. Thermal stress calculations may be used to determine the maximum heat flux that can be removed from the rod surface without risking fracture of the glass. Axial gas flow rates with room temperature air will be calculated to provide this heat removal by forced convection. A simple low-flow compressed air nozzle may be used to inject a filtered air flow in the gas-filled annulus between the rod and the flow tube to provide active cooling of the rod. Sensors for inlet and outlet gas temperatures and rod temperature may be used to monitor the rod cooling process.

Control system

The laser control system 42 will be responsible for maintaining coolant flow through the head, voltage control, and flashlamp timing. Conventional units may be used for timing, analog and digital input and output, and capacitor charging.

Coolant flow will be established just prior to the lamp flashing sequence and cut off soon after the sequence is complete. Several solenoid valves will pressurize the coolant tank, allow the coolant to flow, and shut the flow off at the end of the lamp flashing sequence. During the lamp flashing sequence, the control system will monitor several of the coolant system metrics such as pressure, flow rate, and valve position. If during a lamp flashing sequence the coolant system is determined to be operating incorrectly, the control system will shut down the lamp flashing sequence in order protect the laser.

Voltage control may consist of charging the main capacitor bank and then recharging the flash capacitor during the 50 Hz operation. The main capacitor energy storage bank may be charged using a conventional high-voltage or low-voltage charging unit. This capacitor energy storage bank will then be switched to charge the flashlamp pulse forming network. Timing for this charging sequence will be provided by the laser sequencer system. A simple feedback circuit may be used to provide the control system with information concerning the current state of the charging circuit.

Flashlamp trigger and capacitor charging timing will be accomplished using a conventional timing card inserted into a standard desktop personal computer or other microprocessor platform, for example. This system will be capable of controlling the laser timing channels with microsecond precision throughout the entire lamp flashing sequence. Timing waveforms may be developed that will allow the full lamp flashing sequence to be loaded into the sequence system at one time. Fail-safe monitors will be established so that potentially harmful environments are avoided.

One exemplary set of design and operational criteria are provided below, although this example should not be considered a limitation of the invention but merely illustrative of one possible configuration and operational scenario:

- Mines buried as deep as 20 cm in a variety of soil types and moisture conditions may be accessed and neutralized by a high-power laser located more than 10 meters from the mine site.
- A pulsed laser operating at 1.05 μm wavelength with average power in the 10-20 kW range will perform the mine clearing mission substantially better than a continuous laser of comparable average power.
- The time required to neutralize the mine will vary with depth of burial, soil conditions, and standoff distance, but could be as short as 2-4 s for the 20 cm depth in wet clay at 10 m.
- A burst ND:Glass laser system providing 200-300 J/pulse at 50 Hz (10-15 kW average power) is adequate for a portable laser mine neutralization system for integration with a mobile ground vehicle.

Moreover, another exemplary scenario employs a compact ND:Glass burst laser capable of generating 200 to 300 J per pulse with a repetition rate adjustable up to 50 Hz. This burst laser system will provide bursts of pulses having burst durations up to 10 s. The laser device may be designed and configured to transition to a vehicle-portable implementation. It should be apparent that lasing media other than neodymium-based (e.g., Nd:YAG and ND:Glass rod) may be used to practice the invention, as readily known to those skilled in the art.

Furthermore, another exemplary application scenario has the following characteristics:

1.05 μm wavelength,
200-300 J per pulse,
0.6 ms pulse width,
50 Hz pulse repetition rate,
10-15 kW average power, and
10 s run time.

A further exemplary operating scenario has the following features:

a 1.05-μm wavelength pulsed-soil-drilling rates at high-repetition rate;

soil penetration and mine casing heating to HE deflagration temperatures with a 10-m standoff distance; and an Nd:glass laser system with the following parameters:
200-300 J/pulse,
0.5-1.0 ms pulse width,
50 Hz pulse repetition rate,
10-15 kW average power,
10 s run time, and
$M^2 \leqq 20$ at end of run.

A further operating configuration would use a pulsed Nd:glass laser to provide eight 300-J pulses (0.5-ms pulse width) in a train with pulse repetition rate selectable in the 10-1000 Hz range. Prime power will be used to charge an intermediate energy storage bank over a period of 15-30 minutes. The energy will be released in a 10-s burst to fire flashlamps which will pump a Nd:glass laser rod arranged in a simple power oscillator. The Nd:glass rod will be uncooled during the 10-s lasing burst to minimize temperature gradients in the rod. After the burst, the rod will be slowly cooled to the starting temperature while the intermediate energy store is recharged.

It should also be apparent that parameter selections herein such as standoff distance and angle of incidence (angle of entry into the soil) are only illustrative, and may be adjusted and controlled in any suitable manner to provide other such parameter values.

Mine casing material may be accessed at any of various depths in various soils. The standoff distance from the final focusing optic to the target mine casing may be variable, e.g., 10 m or greater. The invention should be understood as having the ability to adapt to such different environment conditions.

One advance made by the inventors was a recognition of the mechanisms and phenomena that surround the interaction between the laser energy and the burial material, namely, the various compositional types of ground material covering the mine through which the laser beam must pass to access the mine. An investigation of these phenomena was undertaken in order to facilitate an understanding of the influence and contributions of different laser configuration profiles on the characteristics of laser penetration and advance. In this manner, it becomes possible to optimize or tailor the system in terms of being able to preferentially select the type of penetration mechanism for a particular burial environment of a mine of interest.

A series of tests were conducted with high-power lasers to measure the penetration behavior of high-power beams into soils of different types.

Measurements of Laser Interactions with Soil

A series of laser exposures of soil samples were conducted to assess the nature of the interaction of high-power laser beams with soils and to measure the rates for soil drilling or soil removal for various beam parameters. Laser tests are conducted at two different wavelengths, as discussed below, although comparable results are expected at other wavelengths.

Laser Testing at 10.6 μm Wavelength

A 10 kW CW $CO_2$ laser was employed in a series of soil exposures with a focused beam (Test Series-1).

Test Series-1 Approach

Figure 5:
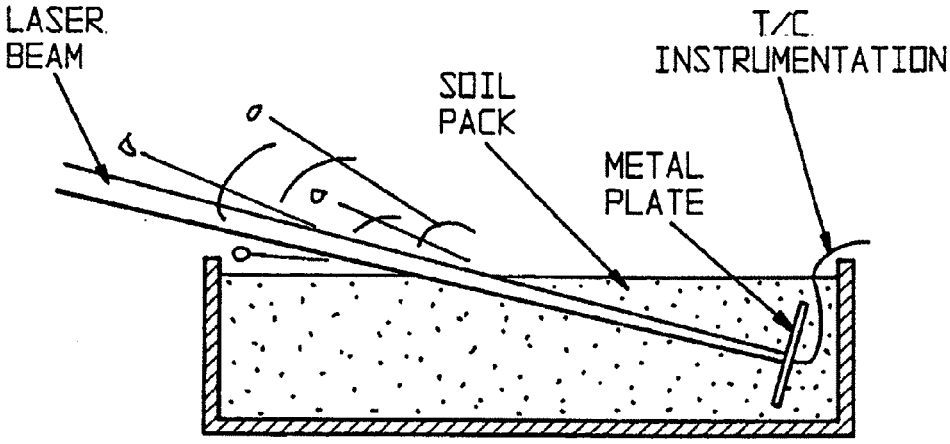
FIG. 5 is a diagrammatic illustration of a test module for demonstrating operation of the burst laser system of the invention.

Soil samples were prepared using dry sand, dry clay, and a mixture of dry pea gravel and dry construction gravel. The soil samples were placed in constructions such as the box design diagrammatically shown in FIG. 5. Prior to placing the soil sample in each box, a steel plate was positioned at 45 degrees to simulate a metal mine casing. The steel plates were fabricated from C1018 steel (3 inch by 3 inch by 0.125 inch) and were instrumented with a single thermocouple peened into the back surface of the plate at the center.

The soil samples were placed on an optical table in a position to receive the beam at a 45 degree angle. The 10 kW $CO_2$ laser delivered a multimode beam with a flat-top spatial profile and had a run time of about 60 s. The raw beam was about 100 mm in diameter and was focused to a 6-mm spot diameter with a 1-m focal length optic.

The waist structure of the focused beam was such that the beam diameter varied considerably over the diagonal distance through the soil from the soil surface to the steel plate. This likely would not occur in the application scenario, where long focal length optics (10-30 m) would be used to collimate the laser beam for soil drilling, but was unavoidable in the testing in order to provide significant irradiance levels on the soil. The waist of the beam was placed half way along the drilling path to maximize the irradiance level in the soil. The beam diameter varied in the range of 6 to 14 mm over the drill path. In some cases the surface of the soil was lowered to produce a higher initial irradiance on the soil surface.

In some cases water was added to the soil sample to simulate field conditions. For the sand and gravel samples, the water was added slowly to the top of a dry soil pack and was allowed to soak in prior to testing. For clay, the water was mixed in as the clay was added to the box to achieve sample uniformity.

Diagnostics for the test-1 series included the plate thermocouple, measurement of mass loss and hole depth, close-up video, wide-angle video, and high-speed video. Laser beam power was controlled at 10 kW and digital records of the beam power and thermocouple output versus time were obtained. Twenty-three laser exposures of soil samples were conducted over a two-day period. The laser beam exposures lasted up to 60 s, unless the steel plate was observed to heat up, in which cases the run was terminated.

Test Series-1 Results

While the laser drilling depths were limited by the laser beam waist structure, the tests indicated clearly that 10 kW class CW lasers can penetrate soils at moderate irradiance levels. The mechanism of drilling for this laser appeared to be similar to that seen in metal drilling.

In particular, the laser beam establishes a melt front in the hole (in this case silica glass) and vaporizes some of the melt on the surface of the melt. The vapor pressure thus produced forces the molten material out of the hole, exposing cooler material to the beam. If the irradiance is low (<20 kW/cm2), the vapor pressure is insufficient to clear the molten material from the hole and a melt puddle is formed.

For irradiance levels greater than 20 kW/cm2, the drilling mechanism is operative and narrow holes of the order of the beam diameter are formed in the soil. The drilling phenomenon was observed for all soils tested (wet or dry), except that in the case of dry clay, some wall collapse was observed which slowed drilling. The starting condition of the dry clay was not compacted as might be the case in a real scenario.

One notable result was that the dry sand was drilled efficiently. It was anticipated that dry sand might collapse into the beam path, preventing hole formation. In this case, however, the molten glass flows along the outer wall of the hole forming a cylindrical glass wall. For this demonstration, a cylinder was formed for an exposure with soil surface irradiance near the threshold for drilling (21 kW/cm$^2$). The drill time (time at which plate heating was observed) was 17 s in this case and the center of the rear surface of the plate reached 300 C in 23 s from the beginning of the run. These values overestimate the drill time and heating time because the intersection of the beam axis with the plate was off center (thermocouple location) by about a centimeter as evidenced by post-test sample examination of rear surface oxidation patterns.

The radial conduction time calculated from the edge of the beam to the thermocouple is about 4 s. The laser beam was set to intersect the center of the plate, but some guiding of the beam by the glass wall probably occurred. Based on a previous run with a shallower sand depth, half of the drill depth was achieved in 4 s. The laser tests with wet sand gave similar results although the drill times were longer. The wet sand did not produce glass tubes except near the target plate, however in this case wall collapse was prevented by the firmness of the soil pack.

Dry and wet clay samples were also exposed in the test series. For this demonstration, a glassy tube was formed with a wet clay sample exposed to a soil surface irradiance of 27 kW/cm2. In this case, the drill time was 12 s and the time to 300 C on the rear surface of the plate was 15 s. While the outer surface of the glassy tube tapered down toward the target end, the beam waist was close to the entrance end. This would have indicated that there may have been some beam guiding effect created by the glassy wall. The dry clay was not sufficiently compacted to prevent wall collapse and drilling was not achieved in these limited tests.

The dry gravel mix was also drilled by the 10-kW laser beam. There was observed an agglomeration of gravel and gravel fragments with the glassy wall, which had a foamy structure. The time to drill to the target was 11 s and the time for the thermocouple to reach 205 C was 19 s. Again, these times are overestimated because the beam axis was guided off center. A white deposit formed which is believed to be condensed silica or alumina formed as the vapor flows through the open structure of the gravel pack. For the gravel case, the presence of water did not affect the results significantly. Water did not fill all of the gaps in the pack, however, because the boxes were not leak proof.

Generally, as observed from these demonstrations, when the soil surface irradiance level was below 20 kW/cm$^2$, the molten material would form a puddle that would grow in size as cold material fed in from the sides. The dominant effluent from the interaction was a white plume which was assumed to be condensed silica and alumina from the vapor formed at the melt surface.

The mass loss measurements indicated that the effective heat of mass removal from the soil sample (Q*) was 14-32 kJ/g, which is consistent with a vaporization mechanism. It is important to note that at low irradiance, the material removed was over an area much larger than the beam diameter because of the puddle and, therefore, the removal did not provide access to the target in times of interest.

For the high irradiance cases (>20 kW/cm$^2$), the demonstrations revealed a greater incidence of discrete material removal (molten or solid) in addition to the white plume of vapor condensate. The directionality of the ejected material was clearly indicative of hole drilling. The Q* values for the hole drilling cases were generally lower than for the puddle conditions, with values in the 10-14 kJ/g range except for dry sand which was 26-32 kJ/g. The important difference for the high irradiance tests was that the mass was removed from a small diameter cylindrical volume which allowed the beam to access the target at a higher rate.

Figure 6:
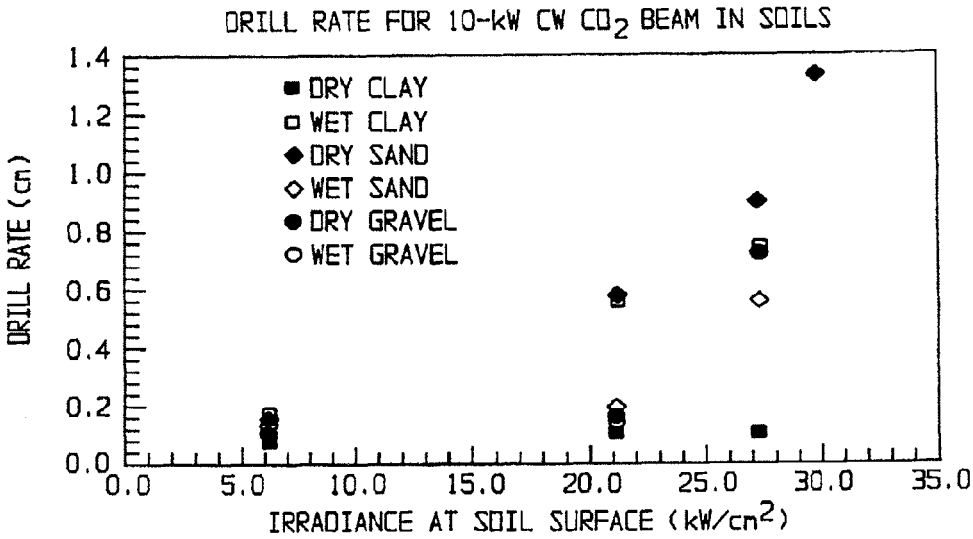
FIG. 6 is a graph of drill rate versus irradiance level at the soil surface.

According to one aspect of the invention, the rate of drilling is meaningful for assessing the value of a set of laser parameters for accessing a buried mine for neutralization. FIG. 6 presents a summary of all of the data from the test-1 series in terms of rate of advance of the hole (drill rate) versus initial soil surface irradiance. As stated above, these rates are underestimated, in some cases, due to guiding of the beam away from the thermocouple position on the buried steel plate.

While the beam waist structure of the relatively low beam quality $CO_2$ laser beam limited the total drill depth achieved in the test-1 series, the trend in the data clearly shows that drilling of soils with 10-kW class beams is feasible. The data suggest that the soil surface irradiance should be greater than 30 kW/cm$^2$. The drill depth for some mines may be as much as 30-40 cm depending on incidence angle of the beam with the soil. Assuming that the drill rate rises to about 2 cm/s at 50 kW/cm$^2$ (extrapolation of the data), then the 10-kW CW $CO_2$ laser could reach the mine in times of the order of 15-20 s. While these are reasonable times, the Q* values were all in the 10-35 kJ/g range, indicating that considerable beam power is wasted in vaporizing material.

It is believed that substantial improvements in soil penetration rates could be realized if more material could be removed in the solid form, i.e., lower effective heat of removal (Q*). According to another aspect of the invention, it is appreciated that the use of a high-repetition rate pulsed laser planned for the mine neutralization system disclosed herein will be able to remove solid material with much greater efficiency than was observed for the continuous $CO_2$ laser in the test-1 series. To demonstrate this on a pulse by pulse basis, additional testing was performed with a Nd:glass laser, as discussed below.

Laser Testing at 1.05 μm Wavelength

The test-1 series discussed above was conducted with a continuous laser operating at the 10.6 μm wavelength. However, it was observed by the inventors that pulses would be able to generate higher peak irradiances, which could potentially eject soil materials more efficiently. Furthermore, the 10.6 μm wavelength has a short absorption length in silica-rich material and water, while shorter wavelengths near 1 μm would be expected to penetrate these materials to a greater depth and provide a mechanism for efficient "cold" material ejection. Individual pulse effects were studied to assess high-peak irradiance and wavelength dominated phenomena, as discussed below. These observations are deemed applicable to the pulsed Nd:glass laser (e.g., 1.05 μm) discussed herein.

Test Series-2 Approach

In order to study pulse effects on soils at 1.05 μm, soil samples were configured and exposed to pulses produced by the ADL laser device provided by LSP Technology of Dublin, Ohio. This laser normally provides 20-ns, 50 J Q-switched pulses at a low repetition rate (0.125 Hz) for laser shock processing research. For the test-2 series, the laser oscillator was operated with the q-switch open (normal mode). In this mode, the ADL laser provided 100 J pulses with a 150 μs pulse width at the 0.125 Hz repetition rate. The oscillator provided a very high quality beam, which could be focused to spot diameters in the 1-5 mm range with a 2 m focal length lens. Mirrors were arranged to provide a 45° incidence angle of the beam on the soil surface. Two soil sample arrangements were exposed to the ADL beam as discussed below.

Test-2 Series Results

In order to measure the mass loss accurately for single 100-J pulses, it was necessary to place samples of soil in small plastic boxes (2.5 by 2.5 by 1 inch deep) that would not exceed the limits of the microbalance used for the measurement. Samples of soils of each type studied in the test-1 series were exposed to 1 or 3 pulses with measurements of mass before and after the tests. The results with the pulsed laser were quite different from those seen in the 10-kW $CO_2$ laser test, as was expected.

For example, with a dry sand sample after exposure to a sequence of 3 pulses at 95 J/pulse, there was no evidence of any melt, but a large quantity of sand was ejected from the box forming a conical shaped crater. The smoothed peak irradiance for each pulse was 66 MW/cm$^2$, which would be expected to form very high vapor pressures locally, which resulted in a sweeping out of the loose material. This irradiance is well below levels for plasma formation at this wavelength, so beam blockage by plasma probably did not occur. A piece of burn paper placed under the plastic box showed that the beam was transmitted through the entire depth of sand by the third pulse. The efficiency of removal of mass for this test was very high. The Q* value was 0.03 kJ/g, which is three orders of magnitude lower than that observed for the CW laser beam acting on dry sand.

Compared to continuous irradiance, it is appreciated that a different mechanism of soil removal may be possible with pulses, i.e., uncovering rather than hole drilling or perhaps some combination of both. Assuming that the Q* value holds for the device (150 kJ total delivered energy), then one might expect to remove 5 kg of sand. Very similar cratering behavior and Q* values were observed for dry clay, while dry gravel exhibited a Q* value of 0.07 kJ/g.

The "digging" mechanism demonstrated for dry soils may be somewhat modified at high pulse repetition rate (high average power) where retained heat from previous pulses may allow some glassy melt formation and hole drilling. For wet clay and wet sand, there was no collapse of the wall and hole drilling was observed even at low pulse repetition rate. In one demonstration, there was employed a wet clay sample after just 2 pulses at 94 J/pulse with a 1.1-mm diameter beam spot at the soil surface. The amount of soil removed was significant and, in this case, the removal was in the shape of a drill hole with no wall collapse. The diameter of the hole (11 mm) was considerably larger than the beam diameter. It was observed that the second pulse damaged the plastic box and left a burn pattern on the burn paper under the box. This observation and mass removal measurements for a single pulse suggest that most of the mass removal occurred on the first pulse for this case. The Q* value for this test was 0.02 kJ/g, which again is exceptionally low for laser material interactions. Similar hole drilling behavior was observed for wet sand for 3 pulses, although the Q* value was higher (0.14 kJ/g)

The Q* values are low for the pulsed laser compared to the CW laser results because the mass removal is a relatively cold process with a small amount of vaporization creating pressures sufficient to remove large quantities of unheated material. No glass formation was observed as seen in the test-1 series for all soil types. The pressure driving the mass removal is a function of the peak irradiance in the laser beam pulse.

Figure 7:
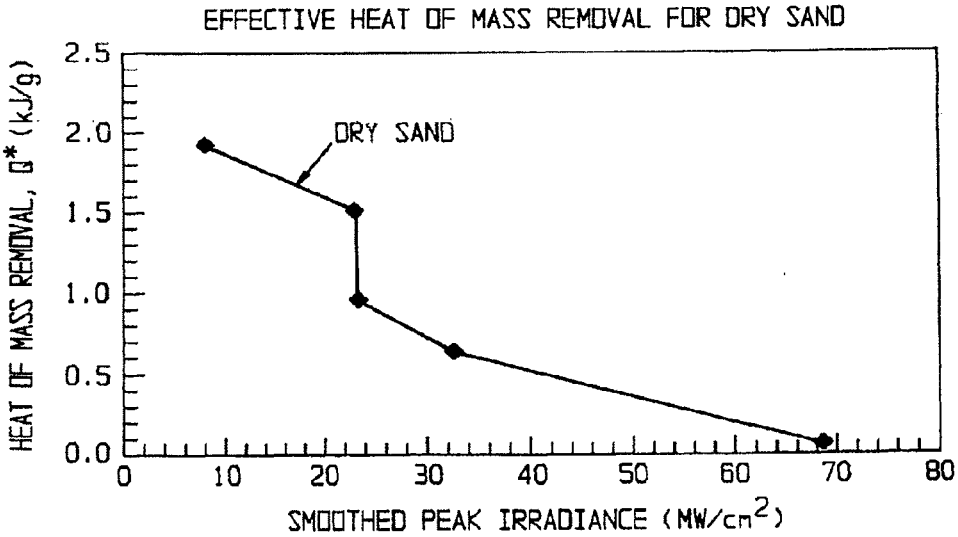
FIG. 7 is a graph of heat of mass removal versus peak irradiance.

To demonstrate this, measurements of mass removal in one pulse were taken as a function of laser beam spot size at the soil surface. These results for dry sand are presented in FIG. 7 in terms of Q* versus smoothed peak irradiance for spot sizes ranging from 1.1 mm to 3.2 mm. The higher two values of Q* are single pulse values, while the remaining three are for trains of three pulses on the sample. The data suggest that successive pulses are more effective than the first pulse. It is clear that the higher the peak irradiance, the more efficient the removal of soil mass for this material.

Further tests of deep-hole drilling were conducted, as summarized below.

Test-2 Series Results (Deep Hole Drilling)

The mass removal results achieved in the small box tests suggested that deep holes might be drilled at low repetition rates for the soil materials that do not flow freely (wet clay and wet sand). Soil samples of these two materials were prepared using buried metal plates and the wooden boxes employed in the test-1 series.

For these tests, the boxes were filled to the top with soil material. For this demonstration, there was used a wet clay sample with exposure to 25 pulses with energy of 98 J/pulse and a spot size of 1.9 mm (23 MW/cm2) at the surface of the soil. The pulses were delivered in a sequence of 10, 10, and 5 pulses to permit measurement of the hole depth as it progressed toward the target plate. The pulses were stopped when heating of the plate was observed. The measurements were performed by placing a graduated rod in the hole after each test sequence. The average drill rate was 0.64 cm per pulse through wet clay. If the pulses had been delivered at a repetition rate of 50 Hz and single pulse mass removal effects were similar to those demonstrated, the drill rate would be 32 cm/s and the hole would have been drilled in 0.5 S. Similar hole drilling results were obtained for wet sand, however the drill rates were lower.

Figure 8:
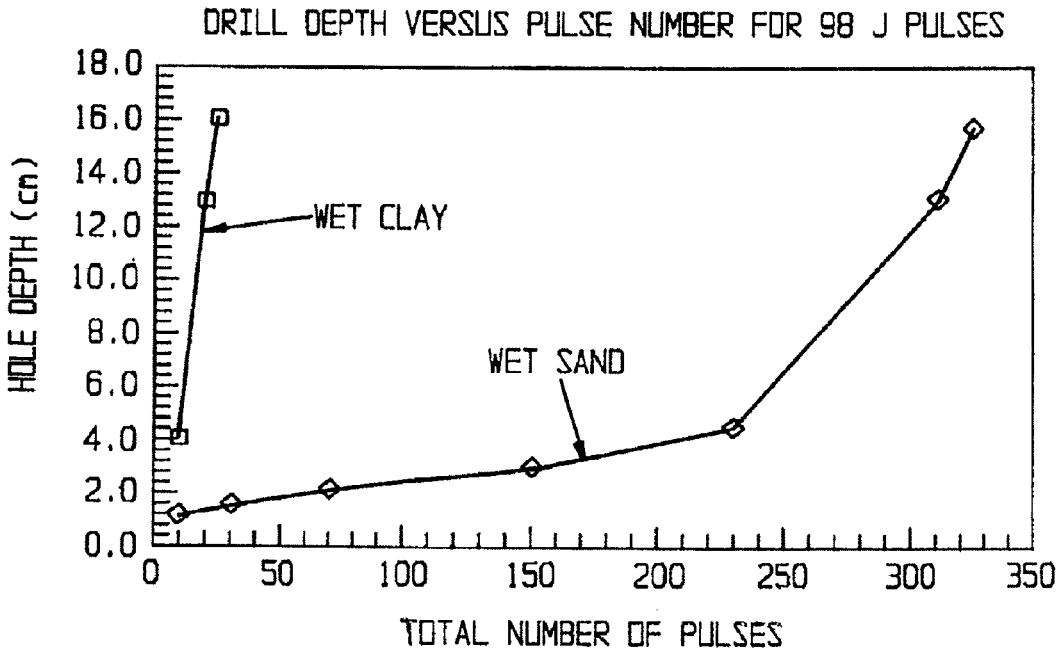
FIG. 8 is a graph of hole penetration depth as a function of delivered pulse count.
Figure 6:
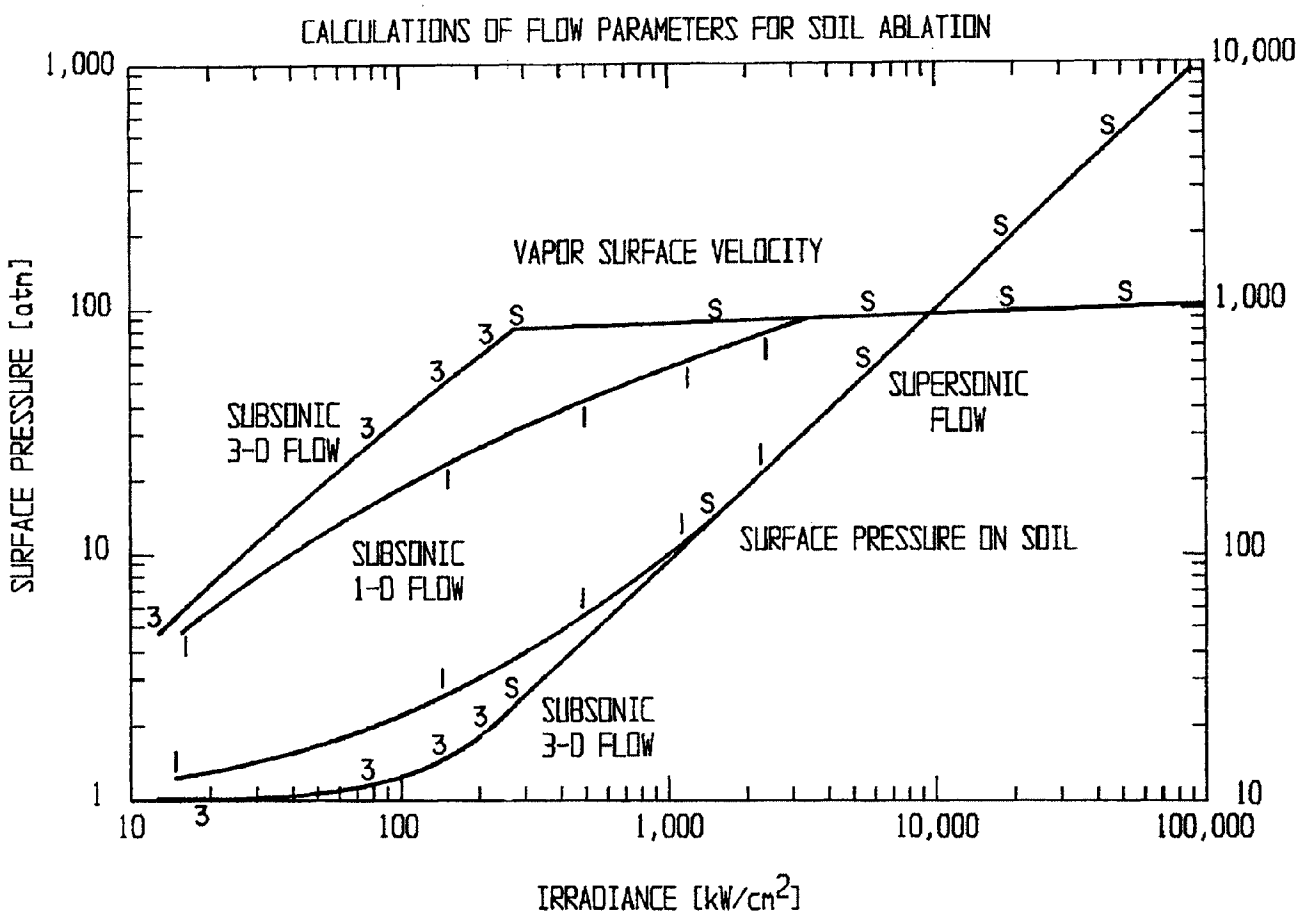

FIG. 8 presents the results of hole depth measurements versus pulse number for wet clay and wet sand exposed to 98 J pulses at 0.125 Hz with a 1.9-mm beam spot diameter at the soil surface. The slope of the curve is the relative drill rate, which is quite high for wet clay from the beginning of the tests. The wet sand drill rate appears to be slow at first, but increases substantially as the aspect ratio of the hole increases. It is believed that the mechanism of the increase in drill rate for wet sand is perhaps related to the hole geometry or to the increase in irradiance as the hole depth increases. Extrapolating to 50 Hz pulse repetition rate, the target plate could be reached through wet sand in 6.5 s with 98 J pulses (5 kW average power).

Q* values were not measured for the deep drilling tests with the pulsed laser, but estimates of Q* were made based on the hole diameter and soil density. These values were in the range of 0.1 to 1 kJ/g, which are considerably lower than those measured for CW laser beams.

Discussion of Test Results

The test results with small spot sizes (high irradiance) suggested that the physics of soil removal with pulses may involve several interacting phenomena.

Soil Removal Phenomenology

Common scenarios place buried mines 4 inches to 8 inches beneath the surface. If the laser engages them at a 45° angle, then approximately 15 to 30 cm of soil must be penetrated to reach the target. Most soils, such as clay, sand, and gravel, are chemically dominated by compositions such as $SiO_2$ (quartz sand) and $Al_2O_3SiO_2.xH_2O$ (common clay), and erosion products of feldspars ($NaAlSi_3O_8$ and $KAlSi_3O_8$).

The effective heat of ablation (mass removal) by vaporization for these materials is approximately 15 kJ/g to 20 kJ/g, and the density of the soil is typically in the range of 2.6 g/cm$^3$. Drilling though the soil to the buried mine by vaporization will require a fluence of approximately 0.4 to 1 MJ/cm$^2$. For typical engagements with a spot diameter exceeding 1 cm and average laser power limited to 1 kW, the resulting penetration times may be too slow. Furthermore, the irradiance may not even be high enough to cause efficient vaporization.

According to another aspect of the invention, the long penetration times may be avoided if the laser system can engage the soil at much higher irradiance. High irradiance leads to rapid penetration times since the vaporization rate scales with the irradiance, to first order. For example, a 100 kW/cm$^2$ average irradiance would supply 1 MJ/cm$^2$ needed to drill to a buried mine in less than 10 s. Either increasing the power or reducing the spot size (or a combination of both) will enhance the average irradiance. Fortunately, buried mines are expected to be engaged at stand-off distances of approximately 10 m, so that spot sizes as small as 2 mm in diameter are feasible with reasonable optics and beam quality at 1054 nm. The average irradiance for a 2 kW system could then exceed the 100 kW/cm$^2$ example requirement.

One notable issue for this approach is whether the drill hole will remain open or be refilled by the collapse of the walls. In the worst case, in which the overlying soil continually refills the hole, penetration will not occur until all of the overlying material is removed, not just that in the drill hole. This would require far more mass removal than feasible by vaporization, even with increased laser power.

However, engaging at high irradiance may avoid these problems since significant surface pressure will be developed as the irradiance increases. The details of the plume characteristics and surface pressure depend on the restrictions imposed by the walls of the hole and the properties of the vapor. Reasonable bounds on the surface pressure have been calculated from existing models and typical vapor properties. FIG. 9 provides an example prediction for the surface pressure and vapor velocity as a function of irradiance for material with nominal soil characteristics (heat of vaporization of 11.1 kJ/g and heat of ablation, including reflectivity, of 16 kJ/g). The surface pressure predictions are plotted as the lower two curves, and the surface vapor velocity as the upper two curves. The portion labeled by the number "3" assumes that radial expansion maintains the vapor pressure at one atmosphere outside the Knudsen layer.

The overpressure at the surface is quite low, and the vapor flow reaches Mach 1 (M =1) at the Knudsen layer at an irradiance of approximately 300 kW/cm$^2$. Alternatively, if the walls of the drill hole are capable of constraining the flow, the subsonic portion will approximate a one-dimensional flow prediction labeled by the number "1". The surface pressure will be higher than the 3-D flow surface pressure, and the flow will not reach M =1 until approximately 3 MW/cm$^2$.

At higher irradiances, the vapor flow is choked (M=1) at the Knudsen layer and the pressure rises almost linearly with irradiance (curves labeled by letter "S"). In this regime, the plume will be supersonic during its initial expansion. (At irradiances below 10 kW/cm$^2$, convective flow is quite slow and diffusion will provide important contributions.)

The high surface pressure and high velocity plume jet offer several potential methods of achieving rapid soil penetration, namely:

1. The high pressure vapor jet may prevent wall collapse thereby avoiding undue increases in the amount of mass that must be removed to penetrate to the mine. The high irradiance beam need only vaporize the material in its path, resulting in rapid penetration.
2. The supersonic jet may entrain particles on the sides of the hole, sweeping them out of the hole without interfering with beam. The enlarged hole will be even less likely to interfere with the beam. (It is important that the particles do not migrate into the beam path, which would cause beam blockage.) Again, only the material in the initial laser beam path need be vaporized.
3. The high pressure jet may rapidly expand laterally, ejecting overlying materials. This will not reduce the fluence required to penetrate, but will avoid beam blockage, and will also create an enlarged hole that may permit the mine location to be observed, even if the beam misses the mine by a small offset distance.
4. The high surface pressure may displace material ahead of the ablation front in the soil, creating a crater. This is most likely in soils that flow easily, but as the irradiance increases, the higher pressure can move even more resistant materials. (Pieces of gravel that are bigger than the beam diameter are unlikely to be moved, but may be cracked or ablated) Cratering may reduce the fluence necessary to penetrate to the mine since it displaces some material in front of the ablation front prior to heating it.

Other phenomena may aid in the soil removal process, such as in-depth vaporization. Many of the pure chemical components of soil (e.g., $SiO_2$, $Al2O_3$, and $H_2O$) are relatively transparent at 1.05 μm. In-depth effects are less important for 10.6 μm laser beams since the absorption depth is relatively short (<10 μm) for all of the soil components. There is the potential for some of the laser beam to penetrate below the surface, either through gaps between the soil particles, or by transmission through transparent portions of the soil mixture.

At high irradiance, subsurface heating can induce vaporization, which may produce very high pressure if the vapor cannot easily escape through pores. The pressure will increase until the overlying material is moved, which may result in its being "blown off". This process is particularly dramatic for in-depth absorption at high irradiance in a "pure" material. Vaporization commences at internal nucleation sites, and then the heat already absorbed in the surrounding material provides the energy source to vaporize more material rapidly as the bubble begins expanding (much like the growth of gas bubbles in boiling water, but at much faster rates). The result can be "explosive" vaporization, which can propel overlying material at high velocity. The issues are whether or not subsurface vaporization can either blow away all (several cm) of the overlying material outside the laser beam, and whether or not it can effectively eject material from a deep hole without the beam vaporizing the material as it travels out the hole.

Test-1 Results

The first test series used a 10-kW $CO_2$ laser to simulate the response to average power levels of interest. It could operate for long run times to ensure deep penetrations, but it did not have the correct wavelength, waveform, or ability to be focused to the small spots necessary for creating high pressure vapor. The tests spanned the irradiance regime from 6 to 29 kW/cm$^2$, which corresponds to surface pressures only marginally above atmospheric (expect for possible water vapor contributions).

Measurements included the total mass removed or average Q* (heat of ablation) and the penetration depth or time to start heating a buried steel plate. There was observed a strong variation of the beam size along its path and offsets between the beam path and the location of the plate thermocouples.

In terms of phenomenology, it was observed that at low irradiance (6.3 kW/cm$^2$) the expected vapor velocity is so low that diffusion is expected to be a significant contribution to the vapor transport. The plume was quite large and slow moving. The material in some of the samples collapsed into the hole, which inhibits penetration. In other engagements, a large molten mass was created that was larger than the beam size and appears to have contributions from the melting of material beyond the spot size. Tests on dry clay at different run times indicate that its penetration rate decreases with time, consistent with the observations that material from outside the spot is moving into the beam.

At higher irradiance, (>20 kW/cm$^2$) a well-defined vapor jet is observed, which entrains particles. The number of particles in the jet varied with soil type and moisture content and increased with increasing irradiance. The overall penetration rate varied significantly with soil type and irradiance. Dry clay is difficult to penetrate although it had Q* values slightly less than expected for vaporization of the nominal composition. It appears that wall collapse is an important feature for dry clay for all irradiances tested, presumably because the clay was not in a compacted state initially.

Wet clay, which has a more stable wall, displayed increasingly rapid penetration with increasing irradiance at approximately the expected rate for vaporization. Dry sand had a highly variable penetration rate at the low irradiance, but it was penetrated more rapidly with increasing irradiance, and at the highest irradiance (29.7 kW/cm$^2$) it was penetrated almost twice as fast as expected from vaporization alone.

In contrast, wet sand was more difficult to penetrate, but the penetration efficiency increased dramatically at irradiances above 25 kW/cm$^2$ to a value close to the nominal vaporization rate. Dry gravel displayed a similar rapid increase in penetration rate above 25 kW/cm$^2$; it too rose to approximately the local vaporization rate. Wet gravel was tested only to 21.1 kW/cm$^2$, where it displayed the same very low penetration rate as dry gravel.

In many soils in which the penetration efficiency improves at higher irradiance, post-test examination of the drill hole indicated that a glassy wall had formed at the edge of the drill hole. Since the thickness of an ablating melt layer is normally reduced as irradiance increases, it is possible that the increased vapor pressure facilitated formation of the wall by causing the melt from separate particles to merge and perhaps even flow into open gaps between particles.

These test series-1 results indicate the following:

Wall collapse is a problem that must be avoided for efficient penetration. It occurs in most materials at low irradiance and in dry clay at 27.2 kW/cm$^2$.

Plume characteristics change from slow moving "smoke" to a well-defined fast jet as irradiance increases, consistent with expectations.

Increasing the irradiance improves penetration efficiency of most of the soils. The improvement coincides with formation of a stable wall and a shift from puddle formation to drilling.

The amount of debris entrained depends on the soil type and moisture, and increases significantly with high irradiance.

However, the penetration rate appears to be dominated by vaporization for the continuous laser (CW).

Test-2 Series Results

For the test-2 series, the ADL laser was configured to provide 100 J pulses with a 150 μs duration that could simulate the high irradiance small spot size interactions at 1.05 μm, with pulsing at 0.125 Hertz. The initial tests had a peak irradiance of 66 MW/cm$^2$ and a maximum of three pulses. All five materials (wet gravel was not tested) displayed very low Q* (<<1 kJ/g), and the penetration depths were up to three times deeper than expected from vaporization alone.

Post test observation of the sample indicated that the overlying material was either blown away (for dry clay and dry sand), or a large hole much greater than the beam diameter was created. Additional tests on dry sand for a range of irradiances suggest that the total mass removal increases with irradiance at the same total energy.

Later tests were performed on wet clay and wet sand with a somewhat larger spot size and lower peak irradiance (23 MW/cm$^2$) to assess whether the drilling process would persist to large depths. Clay was penetrated a distance of 16 cm with 25 pulses, whereas wet sand required 325 pulses. At the beam center, the clay is essentially removed at 2 kJ/g, i.e., in the cold state. This suggests a possible role for water vaporization in this case.

The sand tests showed three different penetration rates. After the first several pulses, in which there was rapid removal, approximately 230 pulses were necessary to penetrate 4 cm, for a local Q* of 76 kJ/g, which is approximately 5 times the expected Q* for vaporization of sand. Then the final 12 cm were penetrated in 90 pulses, for an effective Q* of 10 kJ/g, somewhat below the vaporization value for sand. These results indicate the ability to optimize the laser parameters for soil penetration.

In particular, these results suggest that engagements at high irradiance will provide the desired rapid penetration of soil, and that wall collapse will not be issue for the high-repetition-rate pulsed laser.

Furthermore, the demonstrations indicate that high irradiance interactions can efficiently remove soil to penetrate to a buried mine. In one exemplary set of laser parameters, irradiances of the order of several tens of $MW/cm^2$ are believed to successfully initiate and complete neutralization. Penetration efficiency will likely continue to improve as irradiance increases, at least for dry sand. Also, the higher the pulse energy, the more likely the pulse can continue to expel overlying dry debris as a deep crater develops.

According to another exemplary set of operating parameters, the system will employ pulse parameters of 200-300 J/pulse, 0.6 ms pulse duration, and 50 Hz repetition rate for a total burst time of 10 s. Irradiances of tens of $MW/cm^2$ will provide the desired penetration rates, for example, with a spot size at least 1.9 mm (test-2 spot size). The system will provide 12-18 $MW/cm^2$, which meets the desired minimum irradiance requirement at the test-2 spot size, and may provide even more efficient penetration at smaller spot sizes.

It is expected that the use of a comparatively higher repetition rate will provide even better performance than the test-2 results because there is less time for the hole to collapse, and for water vapor to percolate between grains. The total fluence available in the burst with a 1.9 mm spot diameter will be 4-5 $MJ/cm^2$, which is several times the nominal vaporization fluence to penetrate to the buried mine and will accommodate less efficient mass removal such as observed on wet sand.

The test results show that the burst laser system described herein provides a repetitive pulse capability able to efficiently penetrate the soils of interest and access the mine with sufficient integrity (e.g., power delivery) to accomplish neutralization.

The following documents cited below are incorporated herein by reference thereto:

R. G. Root, O. C. Hofer, R. F. Adamowicz, F. P. Gibson, and J. R. Jones, "MOLADS Target Response Modeling Analysis", 29 Aug. 1986, SPARTA, Inc.

D. Deason and O. C. Hofer, "ZEUS System for UXO and Landmine Clearance", Paper APP-1, in DEPS Proceedings of Fourteenth Annual Solid State and Diode Laser Technology Review, May 21-24, 2001.

C. T. Walters, J. L. Dulaney, B. E. Campbell, and H. M. Epstein, "Nd-Glass Burst Laser with kW Average Output", IEEE Journal of Quantum Electronics Vol. 31, No. 2, pp. 293-300, February, 1995.

R. J Lewis, Sr., Hawley's Condensed Chemical Dictionary, 12th Ed., Van Nostrand Reinhold Company, NY, N.Y. 1993.

S. Anisimov, "Vaporization of Metal Absorbing Laser Radiation," Soviet Physics, JETP, 27, 469-486 (1968).

C. J. Knight, "Theoretical Modeling of Rapid Surface Vaporization with Back Pressure," AIAA Journal, 17, 519-523 (1979).

C. B. Dane, L. Flath, M. Rotter, S. Fochs, J. Brase, and K. Bretney, "Army Solid State Laser Program: Design, Operation, and Mission Analysis for a Heat-Capacity Laser", Paper APP-2, in DEPS Proceedings of Fourteenth Annual Solid State and Diode Laser Technology Review, May 21-24, 2001.

A. Romero and T. Matty, "Advanced Lithium Ion Systems for Directed Energy Power Sources," in DEPS Proceedings of Fifteenth Annual Solid State and Diode Laser Technology Review, Jun. 3-6, 2002.

Detection and Remediation Technologies for Mine and Minelike Targets VI, AeroSense SPIE conference, Apr. 16-20, 2001.

T. M. Watts, D. Cornell, and D. Harris, "Mine Hunter/Killer Advanced Technology Demonstrator", in Detection and Remediation Technologies for Mine and Minelike Targets V, Proceedings of SPIE Vol. 4038, 2000.

Betz, A. J. and Culpepper, R. M., "The Vulnerability of Large Shaped Charge Warheads to Laser Radiation", in Proceedings of the 1977 DoD Conference on Laser Effects, Vulnerability, and Countermeasures Vol. II: Tactical Missile Vulnerability, ERIM 127200-8-X (II).

It should be apparent to those skilled in the art that the numerical values, ranges, measures and specifications mentioned herein are provided for illustrative purposes only and should not be construed in limitation of the invention. Rather, the invention may be practiced in connection with other such values, ranges, measures and specifications, in a manner apparent to those skilled in the art. Accordingly, the construction, design, functional, and operational details described herein (e.g., laser operational parameters and characteristics and system design specifications) are illustrative and not to be considered in limitation of the invention.

The invention is also not limited to the specification of a mine, as it should be apparent that the invention may be practiced in association with any type of ordnance. Moreover, the manner of neutralization preferably employs a non-detonative activity (e.g., deflagration or incineration of the high-explosive material), although detonation is also possible with the invention. Any other laser-related neutralization process is also encompassed by the invention.

Although not part of the invention, any conventional means known to those skilled in the art may be used to identify the location of a mine or detect the presence of a mine.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for neutralizing at least one of a mine and an ordnance, the at least one of a mine and an ordnance being buried at least in part with material thereabout, the method comprising:

generating laser energy via operating a solid-state lasing medium substantially uncooled during a lasing run;

penetrating the material to the at least one of a mine and an ordnance; and neutralizing the at least one of a mine and an ordnance.

2. The method of claim 1, wherein the generating comprises operating the solid-state lasing medium substantially without cooling thereof until the solid-state lasing medium reaches a temperature where thermal population in a lower laser level begins to significantly lower inversion density.

3. The method of claim 1, further comprising cooling the solid-state lasing medium at a rate limited by a thermal stress fracture level of the solid-state lasing medium, following cessation of operation of the solid-state lasing medium.

4. The method of claim 1, wherein the generating comprises operating the solid-state lasing medium in a repetitive pulsing operation.

5. The method of claim 1, wherein the lasing run is from about 1 second to about 60 seconds.

6. The method of claim 1, wherein the solid-state lasing medium generates a laser beam having a flat top spatial profile.

7. The method of claim 1, wherein the solid-state lasing medium generates laser energy having an average power of from about 10 kW to about 20 kW.

8. The method of claim 1, wherein the solid-state lasing medium generates laser energy having an average power of up to about 50 kW.

9. The method of claim 1, wherein the solid-state lasing medium generates laser energy having an energy of from about 200 J to about 300 J per pulse.

10. The method of claim 1, wherein the solid-state lasing medium generates laser energy having an energy of up to about 500 J per pulse.

11. The method of claim 1, wherein the solid-state lasing medium generates laser energy having a pulse repetition rate of from about 0.125 Hz to about 1,000 Hz.

12. The method of claim 1, wherein the solid-state lasing medium generates laser energy having a pulse repetition rate of up to about 50 Hz.

13. The method of claim 1, wherein the solid-state lasing medium generates pulses of laser energy having a pulse width of from about 150 μs to about 5.0 ms.

14. A method for neutralizing a mine or an ordnance at least partially surrounded by a burial material, the method comprising:

providing a burst of laser pulses from a lasing medium operating in a burst mode of operation;

penetrating through the burial material; and neutralizing the mine or ordnance;

wherein the lasing medium is cooled following cessation of the burst.

15. The method of claim 14, wherein the burst is for a time period of less than or equal to about 60 seconds.

16. A method for neutralizing at least one of a mine and an ordnance, the at least one of a mine and an ordnance being buried at least in part with material thereabout, the method comprising:

generating a burst of pulsed laser energy from a laser system comprising a laser rod; and leaving the laser rod uncooled during the burst until the laser rod reaches a temperature where a thermal population in a lower laser level begins to significantly lower inversion density, wherein the pulsed laser energy comprises sufficiently high average power to penetrate the material and neutralize the at least one of a mine and an ordnance.

17. The method of claim 16, wherein the burst lasts for a time period of up to about 60 seconds.

18. The method of claim 16, wherein the average power is from about 10 kW to about 50 kW.

19. The method of claim 16, further comprising cooling the laser rod following the completion of the burst at a rate limited at least in part by a thermal stress fracture level of the laser rod.

* * * * *